US010194491B2

(12) United States Patent
Okamoto et al.

(10) Patent No.: US 10,194,491 B2
(45) Date of Patent: Jan. 29, 2019

(54) INDUCTION HEAT GENERATION ROLLER DEVICE

(71) Applicant: TOKUDEN CO., LTD., Kyoto-shi, Kyoto (JP)

(72) Inventors: Kozo Okamoto, Takashima (JP); Takatsugu Kitano, Otsu (JP)

(73) Assignee: TOKUDEN CO., LTD., Kyoto-Shi, Kyoto (JP)

( * ) Notice: Subject to any disclaimer, the term of this patent is extended or adjusted under 35 U.S.C. 154(b) by 613 days.

(21) Appl. No.: 14/801,821

(22) Filed: Jul. 16, 2015

(65) Prior Publication Data

US 2016/0021706 A1 Jan. 21, 2016

(30) Foreign Application Priority Data

Jul. 18, 2014 (JP) ..... 2014-147632

(51) Int. Cl.

| | |
|---|---|
| ***H05B 6/04*** | (2006.01) |
| ***G03G 15/00*** | (2006.01) |
| ***H05B 6/06*** | (2006.01) |
| ***H05B 6/14*** | (2006.01) |
| ***H05B 6/42*** | (2006.01) |

(52) U.S. Cl.

CPC ..... *H05B 6/04* (2013.01); *H05B 6/06* (2013.01); *H05B 6/145* (2013.01); *H05B 6/42* (2013.01)

(58) Field of Classification Search

CPC . H05B 6/06; H05B 6/145; H05B 6/04; H05B 6/42

USPC ..... 219/619, 216, 678, 696, 690, 674, 676, 219/715, 716; 399/75, 328, 320, 324, 399/330, 331, 332, 335

See application file for complete search history.

(56) References Cited

U.S. PATENT DOCUMENTS

| | | | | |
|---|---|---|---|---|
| 6,359,269 | B1 | 3/2002 | Hayasaki et al. | |
| 2005/0135828 | A1* | 6/2005 | Joichi | G03G 15/5004 399/75 |
| 2015/0230294 | A1* | 8/2015 | Tonomura | H05B 1/02 219/674 |

FOREIGN PATENT DOCUMENTS

| | | | |
|---|---|---|---|
| DE | 112010003915 | T5 | 11/2012 |
| EP | 2938159 | A1 | 10/2015 |

(Continued)

OTHER PUBLICATIONS

European Patent Office, Extended European Search Report Issued in Application No. 15177245.6, dated Dec. 8, 2015, Germany, 5 pages.

(Continued)

*Primary Examiner* — Quang T Van

(74) *Attorney, Agent, or Firm* — Alleman Hall Creasman & Tuttle LLP

(57) ABSTRACT

The present disclosure, for the prevention of a possible degradation of an induction coil in insulating performance by preventing condensate formation on an induction coil, provides a device that is configured to include a roller main body, an induction heat generator provided in the roller main body and having the induction coil for heating the roller main body inductively, a cooling mechanism configured to introduce a coolant mist into a clearance portion between the roller main body and the induction heat generator for cooling the roller main body, an AC voltage application part configured to apply AC voltage to the induction coil, and a DC voltage application part configured to apply DC voltage to the induction coil.

3 Claims, 2 Drawing Sheets

(56) References Cited

FOREIGN PATENT DOCUMENTS

| | | | |
|---|---|---|---|
| JP | 5739323 | U1 | 3/1982 |
| JP | 2002147964 | A | 5/2002 |
| JP | 2010002806 | A | 1/2010 |
| JP | 2011108399 | A | 6/2011 |
| JP | 2011154952 | A | 8/2011 |

OTHER PUBLICATIONS

Japanese Patent Office, Office Action Issued in Application No. 2014147632, dated Apr. 11, 2018, 5 pages.

* cited by examiner

INDUCTION HEAT GENERATION ROLLER DEVICE

FIELD OF THE INVENTION

The present disclosure relates to an induction heat generation roller device, and in particular to an induction heat generation roller device that includes a cooling mechanism for supplying a coolant mist between a roller main body and an induction heat generator.

BACKGROUND

A type of induction heat generation roller device as disclosed in Patent Literature 1 has been proposed, wherein a coolant mist is made to pass through a clearance portion between a roller main body and an induction heat generator that is provided in the roller main body.

In such an induction heat generation roller device, the roller main body is cooled down by the following factors: a latent heat of vaporization which is generated when the coolant mist contacts with an inner surface of the roller and vaporizes; a sensible heat that is generated due to a temperature increase of the coolant mist between the roller main body and the induction heat generator; and a latent heat of vaporization which is generated when the coolant mist vaporizes due to a temperature increase.

PRIOR ART DOCUMENTS

Patent Literature

Japanese Patent Publication No. 2011-108399 (JP2011-108399A)

SUMMARY OF THE INVENTION

Problem to be Solved by the Invention

In the aforementioned device, in a case where the roller main body receives a large amount of heat from outside, the outer surface temperature of the roller main body tends to exceed a set target value. The device causes the outer surface temperature of the roller main body to approach the set target value by supplying a coolant mist in a continual manner to the roller main body outer surface. Therefore the device is controlled in a manner that minimizes the application of AC voltage.

However, some of the coolant mist serves to cool down the induction coil as well, and if this lowers a temperature of the induction coil to less than a predetermined value, the coolant mist condenses on the outer surface of the induction coil. Thereby, drawbacks may result which include, for example, a degradation of the insulation performance of the induction coil.

At this time, in order to prevent the degradation of the insulation performance of the induction coil which results from the condensed water (condensate) on the exposed surface of the induction coil, it may be possible to provide a resin barrier layer on the outer surface of the induction coil for the protection thereof.

However, it is possible that, for example, the resin barrier layer has defective parts and cements into the outer surface of the induction coil, which makes it difficult to completely prevent the induction coil from experiencing condensation. For this reason, it is difficult to prevent the insulation performance of the induction coil from being deteriorated.

In addition, in cases where the temperature of the roller main body will increase up to 250 degrees Celsius or above, it is necessary to employ a heat-resistant resin as a raw material of the resin barrier layer in order to withstand such a thermal environment. However, the possible heat degradation of the heat-resistant resin may require that inorganic cement be used, instead of resin.

However, due to the fact that the inorganic cement itself is not inherently dense, a possibility of penetration of the condensed water into the induction coil makes it difficult to prevent the degradation of the insulation performance of the induction coil.

In light of the above circumstances, the present disclosure, which is proposed to solve the aforementioned problems, has a principal object of preventing a degradation of the insulation performance of the induction coil by making the induction coil free of condensed water.

Means for Solving the Problem

That is to say, an induction heat generation roller device is characterized by including: a roller main body adapted to be supported for rotation, an induction heat generator provided within the roller main body and having an induction coil for heating the roller main body inductively, a cooling mechanism configured to introduce a coolant mist into a clearance portion between the roller main body and the induction heat generator for cooling the roller main body, an AC voltage application part configured to apply an AC voltage to the induction coil, and a DC voltage application part configured to apply a DC voltage to the induction coil.

Such a device includes the DC voltage application part configured to apply the DC voltage to the induction coil. This allows the induction coil to generate Joule heat, thereby enabling the heating of the induction coil itself. As a result, the possibility of generation of condensate on a periphery of the induction coil is made increasingly unlikely. Furthermore, any condensed water that might adhere on the periphery of the induction coil will be evaporated by the heat of the coil.

Incidentally, in a case of applying the DC voltage to the induction coil, the roller main body is not heated inductively and therefore it does not have an effect on temperature control with respect to a set target value of the roller main body.

It is preferable that the cooling mechanism begin to introduce the coolant mist into the clearance portion between the roller main body and the induction heat generator, after termination of the application of the AC voltage by the AC voltage application part.

With this concept or configuration, upon completion of heating the roller main body by the induction heat generator, cooling the roller main body by the coolant mist begins, making it possible to cool the roller main body in an effective manner. Thus, it is possible to improve control responsivity with respect to the set target value.

It is preferable that the DC voltage application part begin to apply the DC voltage to the induction coil after termination of the application of the AC voltage by the AC voltage application part.

With this concept or configuration, it is possible to avoid a temperature decrease of the induction coil that will generate after completion of heating the roller main body by the induction heat generator, which results in condensate hardly being generated on a periphery of the induction coil and also causes the condensed water adhering on the periphery of the induction coil to be evaporated.

It is preferable that the application of the DC voltage by the DC voltage application part be in a timed relationship with the introduction of the coolant mist by the cooling mechanism. This concept of the "timed relationship" includes that the application timing of the DC voltage coincides with the introduction timing of the coolant mist, and that the application timing of the DC voltage deviates from the introduction timing of the coolant mist by a predetermined time difference.

With this concept or configuration, the advantageous outcome of being able to prevent a temperature decrease of the induction coil, which may occur due to the introduction of the coolant mist, can be achieved.

Effects of the Invention

According to the present disclosure thus configured, which includes a DC voltage application part configured to apply a DC voltage to an induction coil, applying the DC voltage to the induction coil will make it possible to prevent condensate formation on the induction coil, and to consequently prevent the degradation of the insulation performance of the induction coil.

MODES FOR CARRYING OUT THE PRESENT INVENTION

Hereinafter, an induction heat generation roller device according to an exemplary embodiment of the present disclosure will be described with reference to the attached drawings.

An induction heat generation roller device 100 according to the exemplary embodiment of the present disclosure is used, for example, in a continuous heat treatment process of continuous materials such as sheet materials which may include plastic film, paper, cloth, nonwoven fabric, synthetic fiber, metal foil, web material, and wire (thread).

1. DEVICE CONFIGURATION

Figure 1:
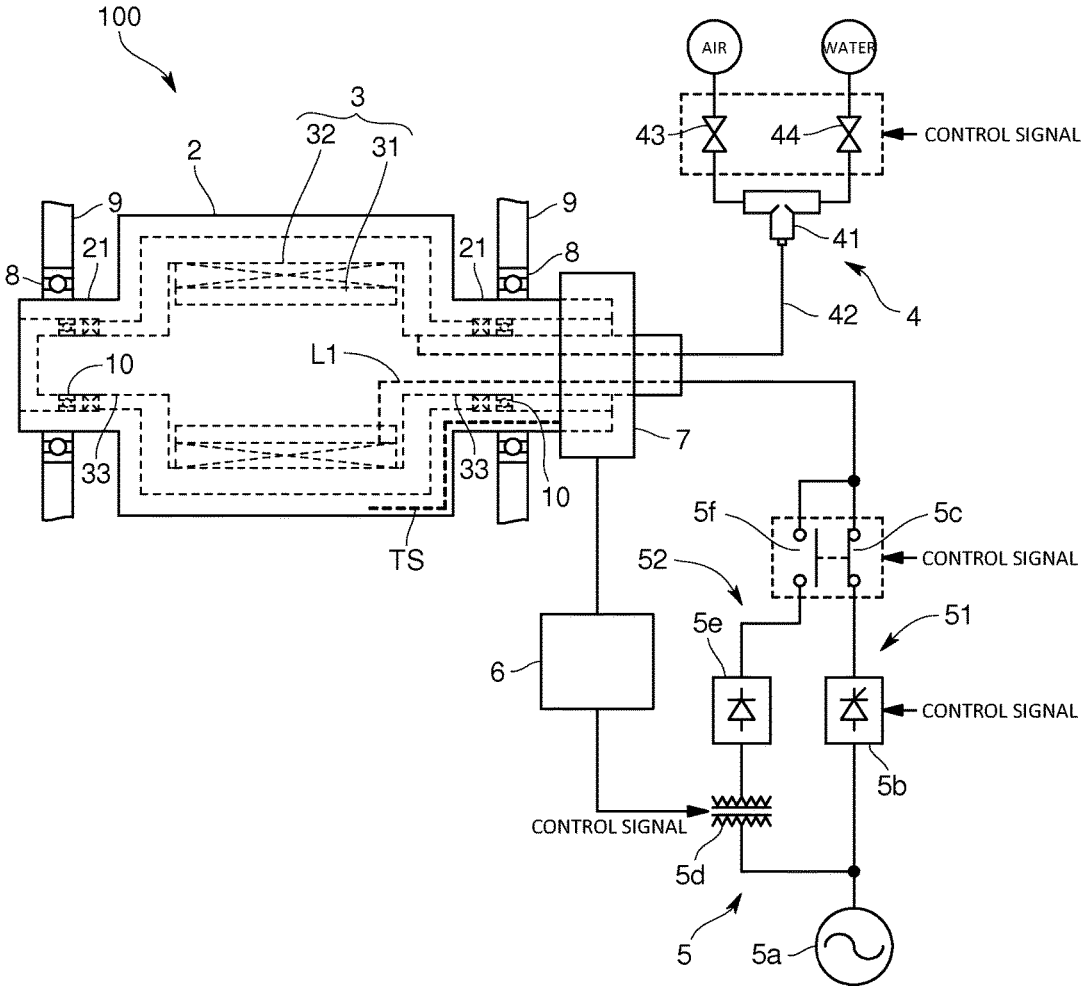
FIG. 1 is a schematic representation of a configuration of an induction heat generation roller device according to an exemplary embodiment of the present disclosure.

In detail, this induction heat generation roller device 100 includes, as illustrated in FIG. 1, the following: a hollow cylindrical roller main body 2 that is adapted to be supported for rotation; an induction heat generator 3 that is provided within the roller main body 2; and a cooling mechanism 4 that is configured to introduce a coolant mist into a clearance portion between the roller main body 2 and the induction heat generator 3, for cooling the roller main body 2.

Both axial end portions of the roller main body 2 are respectively provided with hollow driving shafts 21 that are rotatably supported by a base 9 through bearings 8, such as rolling bearings. The roller main body 2 is configured to be brought into rotation by an externally applied driving force from a rotation driving mechanism (not shown) such as a motor.

The induction heat generator 3 includes a cylindrically shaped core 31 and an induction coil 32 that is wound around the cylindrical core 31.

Both axial end portions of the cylindrical core 31 are respectively provided with support shafts 33 that are extended into the driving shafts 21 and rotatably supported by the driving shafts 21 through bearings 10, such as rolling bearings. Thereby, within the roller main body 2 that is under rotation, the induction heat generator 3 is allowed to be positioned in a fixed, stationary manner relative to the base 9 (fixed side).

In addition, the induction coil 32 is connected with an external lead wire L1 that is connected with a power supply circuit 5 for applying, for example, an AC voltage to the induction coil 32. The power supply circuit 5 will be presented in detail later.

With the thus configured induction heat generator 3, when the AC voltage is applied to the induction coil 32, an alternating flux is generated and the resulting alternating flux passes through side peripheral walls of the roller main body 2. The resulting passage of the alternating flux causes the roller main body 2 to generate an induction current and therefore the roller main body 2 generates Joule heat.

The cooling mechanism 4 is configured to cool down the roller main body 2 by introducing a coolant mist into a clearance portion defined between the roller main body 2 and the induction heat generator 3 from one axial direction end portion of the clearance portion. The cooling mechanism 4 is configured to exhaust the coolant mist outside the roller main body 2 from the other end portion of the clearance portion. It is to be noted that the "axial direction" is indicative of the direction of the axis of rotation of the roller main body 2 which extends in the transverse (right-and-left) direction in the sheet of FIG. 1

In further detail, the cooling mechanism 4 includes: a coolant mist generation device 41 that generates the coolant mist by mixing compressed air and water; and a coolant introduction passage 42 that allows for an introduction of the coolant mist into the clearance portion from the one axial direction end portion thereof. The coolant mist has a particle diameter whose rough size makes it possible to prevent the coolant mist from being evaporated immediately after the coolant mist is sprayed. Concurrently, the rough size allows the coolant mist to not fall by the force of gravity during transfer together with the compressed air and to not be liquefied even though the coolant mist collides with an inner wall surface at a bend portion of a fluid passage. Specifically, the coolant mist has a particle diameter that ranges from 30 to 100 μm.

It is to be noted that in a compressed air supply circuit for supplying the compressed air to the mist generation device 41, there is provided a switching valve 43 that is in the form of an electromagnetic valve for controlling, i.e., selectively supplying and stopping, the compressed air to the mist generation device 41. In addition, in a coolant supply circuit for supplying the water as the coolant to the mist generation device 41, there is provided another switching valve 44 that is in the form of an electromagnetic valve for controlling, i.e., selectively supplying and stopping, the water to the mist generation device 41. Further, in the coolant supply circuit, a flow control valve (not shown) may be provided for controlling an amount of the coolant. Moreover, the cooling mechanism 4 includes a coolant drain passage that it is not illustrated in FIG. 1, in order to drain the coolant that has passed through the clearance portion outside the roller main body 2 from the axial other end portion of the clearance portion.

Incidentally, in the present exemplary embodiment, the power supply circuit 5 includes an AC voltage application part 51 that is configured to apply AC voltage to the induction coil 32 and a DC voltage application part 52 that is configured to apply DC voltage to the induction coil 32.

The AC voltage application part 51 is configured to develop an induction current in the roller main body 2 for generating Joule heat (electromagnetic induction heat). In detail, the AC voltage application part 51 includes an AC power source 5*a* and an AC voltage regulating device 5*b*, which is in the form of a thyristor, for regulating an AC output voltage from the AC voltage regulating device 5*b* in a phase controlled manner. The AC voltage application part 51 is electrically connected, via a switch 5*c*, to an external lead line L1 of the induction coil 32. It is to be noted that the aforementioned electric or electronic components including, for example, the AC voltage regulating device 5*b* and the switch 5*c* are subject to the control of a control device 6 that will be presented in detail later in the document.

The DC voltage application part 52 is for allowing the DC current to flow through the induction coil 32 to develop the Joule heat (direct heat generation by direct current energization). In detail, the DC voltage application part 52 is made up of the AC power source 5*a*, a transformer 5*d* that regulates the AC output voltage outputted from the AC power source 5*a* to a predetermined value, and a rectifier 5*e* that rectifies and converts the AC voltage regulated by the transformer 5*d* to DC voltage. The DC voltage application part 52 is electrically connected, via a switch 5*f*, to the external lead line L1 of the induction coil 32. It is to be noted that, for example, the transformer 5*d* and the switch 5*f* are subject to the control of a control device 6 that will be presented in detail later.

In the present exemplary embodiment, the switch 5*c* provided at the AC voltage application part 51 side and the switch 5*f* provided at the DC voltage application part 52 side are constituted as a single unit type power source transfer switch (for example, static transfer switch). The switches 5*c* and 5*f* are selectively controlled to an "ON" condition by the control device 6, as will be presented in detail later in the document.

The induction heating roller device 100 according to the present exemplary embodiment causes the control device 6 to control each part, and the resulting thermal control of the roller main body 2 allows the temperature (surface temperature) of the roller main body 2 to attain a predetermined set target value.

In detail, a detection signal from a temperature sensor TS that is provided within a peripheral wall of the roller main body 2 is detected as a current signal via an amplifier (not shown) by the control device 6. It is to be noted that a rotary transformer 7 causes the detection signal from the temperature sensor TS to be outputted to the control device 6 by issuing control signals.

2. OPERATION OF INDUCTION HEAT GENERATION ROLLER DEVICE

Hereinafter, the operation of the induction heat generation roller device 100 will be described along with control of the control device 6.

The control device 6, from a start time of initiating the induction heat generation roller device 100, brings the switch 5*c* to be in the "ON" condition, thereby causing the AC voltage application part 51 to apply the AC voltage to the induction coil 32.

Figure 2:
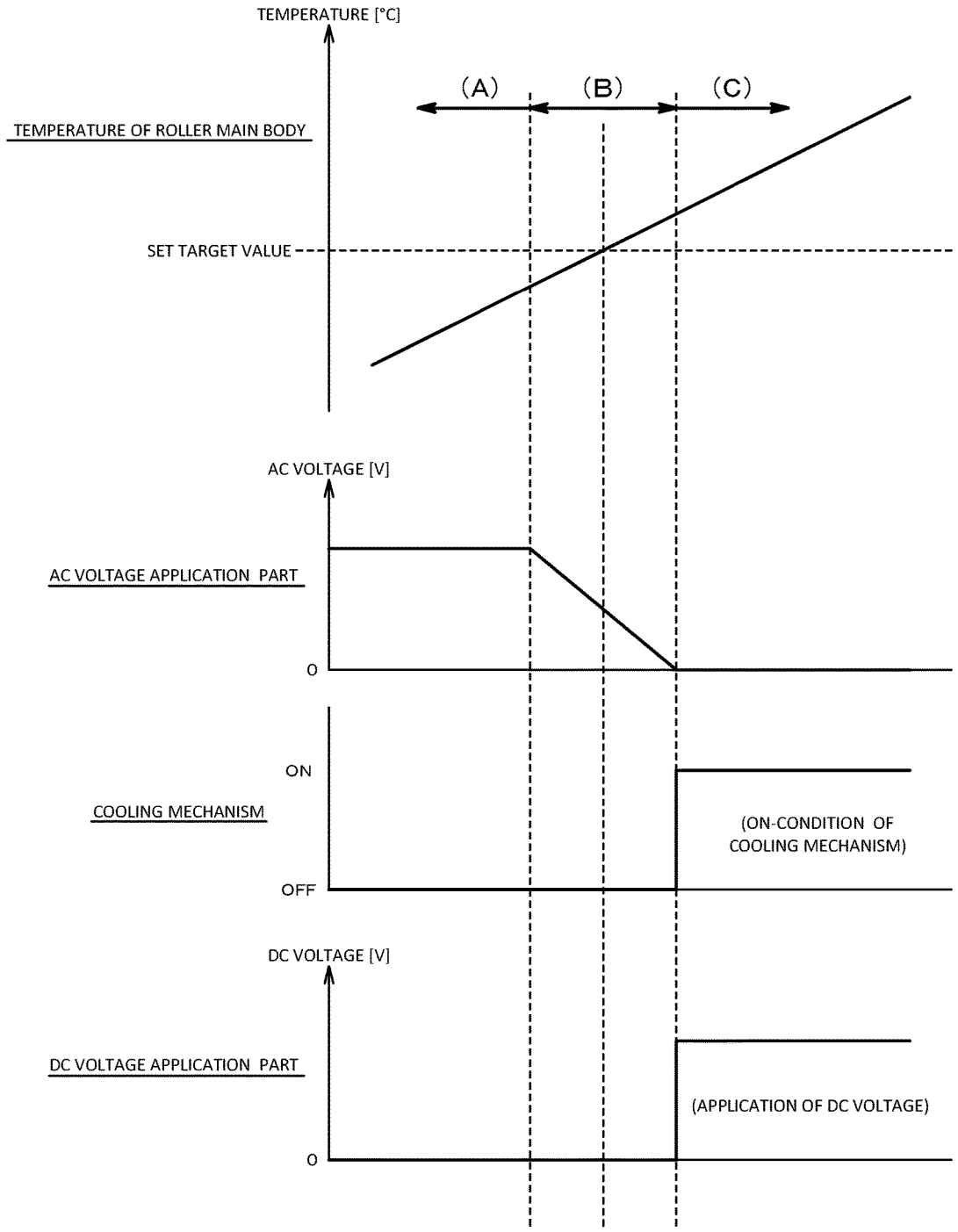
FIG. 2 illustrates an example of a control pattern of the exemplary embodiment of the present disclosure.

Then, in a case where the temperature of the roller main body 2, which is acquired from the temperature sensor TS, is significantly lower than the set target value SV and falls in region "A" (as shown in FIG. 2), the control device 6 controls the AC voltage regulating device 5*b* to apply the maximum voltage that the AC power can supply to the induction coil 32. Thus, the roller main body 2 is self-heated by the induction current passing through it, which is induced by an electromagnetic induction, resulting in a rise in the temperature of the roller main body 2 toward the set target value SV.

Thereafter, in a case where the control device 6 determines that the temperature of the roller main body 2 falls within a proportional band relative to the set target value SV (as indicated by "B" region in FIG. 2), the control device 6 causes, depending on a deviation between the temperature of the roller main body 2 and the set target value SV, the AV voltage regulating device 5*b* to operate in order to establish a feedback control for regulating the AC voltage that is to be applied to the induction coil 32. The "proportional band" here means a temperature range where the voltage control can be performed such that a temperature of the roller main body 2 can be maintained at the set target value SV by controlling only the AC voltage regulating device 5*b*.

Here, there is a case (as indicated by "C" region in FIG. 2) where, for example, the roller main body 2 is in receipt of an external heat input (from, for example, a heat treatment object), resulting in the temperature of the roller main body 2 going beyond the proportional band and reaching an excessively high temperature. The control device 6, upon determination of the excessively high temperature of the roller main body 2 which is beyond the proportional band, causes the AC voltage regulating device 5*b* to operate by bringing the AC voltage that is to be applied to the induction coil 32 to zero. It is also to be noted that the control device 6 is capable of bringing the AC voltage that is to be applied to the induction coil 32 to zero by turning off the switch 5*c* provided at the AC voltage application part 51 side.

In addition, the control device 6, simultaneously brings the AC voltage that is to be applied to the induction coil 32 to zero and opens valves 43 and 44 of the cooling mechanism 4 in order for the mist generation device 41 to generate the coolant mist and subsequently to introduce the resulting mist into the clearance portion between the roller main body 2 and the induction heat generation mechanism 3.

Further, the control device 6, simultaneously initiates the introduction of the coolant mist, which is established by the cooling mechanism 4 and controls the static transfer switch to turn off the switch 5*c* and to turn on the switch 5*f*. Then, the control device 6 controls the transformer 5*d* to regulate the AC voltage to a predetermined voltage value. Thus, the AC voltage that is regulated to have the predetermined voltage value is rectified at the rectifier 5*e*, and the resulting DC voltage that has the constant voltage value is applied to the induction coil 32. In the induction coil 32 that is thus applied with the DC voltage, Joule heat is generated whose magnitude is $I^2$ R, depending on both a winding resistance value of the induction coil 32 and the DC voltage that is applied to the induction coil 32.

Thereafter, in a case where the control device 6 determines that the temperature of the roller main body 2 falls within the proportional band, the control device 6 stops the introduction of the coolant mist by the cooling mechanism 4 and concurrently controls the static transfer switch to turn on the switch 5*c* and to turn off the switch 5*f*. Then, the control device 6 controls the AV voltage regulating device 5*b* depending on a deviation between the temperature of the roller main body 2 and the set target value SV to feedback control the AC voltage that is to be applied to the induction coil 32. Thus, in the present exemplary embodiment, the initiation and termination of the operation of the cooling mechanism 4 are in a time relationship with the initiation and termination of the DC voltage application part 52. Therefore, a period of time during which the coolant mist is introduced by the cooling mechanism 4 coincides with a period of time during which the DC voltage is applied by the DC voltage application part 52.

3. EFFECTS OF THE PRESENT EXEMPLARY EMBODIMENTS

In accordance with the induction heat generation roller device 100 having the aforementioned configuration, the induction heat generation roller device 100 includes the DC voltage application part 52 that is configured to apply the DC voltage to the induction coil 32 and therefore applying the DC voltage to the induction coil 32 allows the induction coil 32 to generate Joule heat. Thereby, it is possible to heat the induction coil 32 itself, which results in condensed water adhered on the periphery of the induction coil 32 being able to be evaporated, and the formation of condensate on a periphery of the induction coil 32 being increasingly unlikely to occur.

It is worth noting that in the present exemplary embodiment, from the moment the coolant mist is introduced by the cooling mechanism 4, the possibility of condensate formation on a periphery of the induction coil 32 exists, though it is very unlikely to occur. This is because starting from the initiation time point of the coolant mist introduction, the DC voltage application part 52 simultaneously applies DC voltage to the induction coil 32.

4. MODIFIED EXEMPLARY EMBODIMENTS OF THE PRESENT DISCLOSURE

It is to be noted that the present disclosure is not limited to the aforementioned exemplary embodiment.

For example, in the aforementioned exemplary embodiment, the initiation timing of the introduction of the coolant mist by the cooling mechanism 4 coincides with the initiation timing of the application of the DC voltage by the DC voltage application part 52; however, both the initiation timings may deviate from one another. For example, it is possible to configure the application of the DC voltage by the DC voltage application part 52 to be initiated after a predetermined time has elapsed from the initiation of the introduction of the coolant mist by the cooling mechanism 4.

In the aforementioned exemplary embodiment, the time interval during which the AC voltage is being applied by the AC voltage application part 51 is configured to not overlap with both the time interval during which the coolant mist is being introduced by the cooling mechanism 4, and the time interval during which the DC voltage is being applied by the DC voltage application part 52; however, it is possible to configure the time interval during which the AC voltage is being applied is to overlap with the time interval during which the coolant mist is being introduced. In such a case, it is possible to configure the time interval during which the DC voltage is being applied is to either overlap with or not overlap with the time interval during which the AC voltage is being applied. In the case where the time interval during which the DC voltage is being applied is configured to overlap with the time interval during which the AC voltage is being applied, the resulting voltage application is configured such that the induction coil 32 will be applied with a superimposed voltage of the AC voltage from the AC voltage application part 51 and the DC voltage from the DC voltage application part 52.

Further, in the aforementioned exemplary embodiment, the DC voltage application part 52 is configured by sharing the AC power source of the AC voltage application part 51; however, the DC voltage application part 51 may be configured to use, instead of the AC power supply source of the AC voltage application part 51, another AC power supply source or a DC power supply source.

Moreover, while the DC voltage application part 52 of the aforementioned exemplary embodiment is configured so that the DC voltage that is to be applied to the induction coil 32 is set to be constant, instead, the DC voltage that is to be applied to the induction coil 32 may be variable.

Needless to say, the present disclosure is not limited to the aforementioned exemplary embodiments and numerous other embodiments may be envisaged without departing from the spirit and scope of the disclosure.

REFERENCE CHARACTER LIST

100 induction heat generation roller device
2 roller main body
3 induction heat generator
32 induction coil
4 cooling mechanism
51 AC voltage application part
52 DC voltage application part

The invention claimed is:

1. An induction heat generation roller device, comprising:
a roller main body adapted to be rotatably supported;
an induction heat generator provided within the roller main body and having an induction coil for heating the roller main body inductively;
a cooling mechanism configured to introduce a coolant mist at a coolant mist introduction timing into a clearance portion between the roller main body and the induction heat generator for cooling the roller main body;
an AC voltage application part configured to apply an AC voltage to the induction coil, and vaporizes the coolant mist that has condensed; and
a DC voltage application part configured to apply a DC voltage to the induction coil at a DC voltage introduction timing that is in a timed relationship with the coolant mist introduction timing.

2. The induction heat generation roller device according to claim 1, wherein, after termination of the application of the AC voltage by the AC voltage application part, the cooling mechanism begins to introduce the coolant mist into the clearance portion between the roller main body and the induction heat generator.

3. The induction heat generation roller device according to claim 1, wherein the DC voltage application part begins to apply the DC voltage to the induction coil, after termination of the application of the AC voltage by the AC voltage application part.

* * * * *